US005467551A

United States Patent [19]

Kruse

[11] Patent Number: 5,467,551

[45] Date of Patent: Nov. 21, 1995

[54] NIPPLE FOR MUZZLE-LOADING FIREARM

[75] Inventor: Albert L. Kruse, Revillo, S. Dak.

[73] Assignee: Modern Muzzleloading, Inc., Centerville, Iowa

[21] Appl. No.: 343,219

[22] Filed: Nov. 22, 1994

[51] Int. Cl.[6] ..... F41C 9/08

[52] U.S. Cl. ..... 42/83; 42/51

[58] Field of Search ..... 42/51, 83

[56] References Cited

U.S. PATENT DOCUMENTS

| | | | |
|---|---|---|---|
| 60,791 | 1/1867 | Rowe | 42/83 |
| 3,757,447 | 9/1973 | Rowe | 42/51 |
| 4,163,335 | 8/1979 | Ives | 42/83 |
| 4,519,157 | 5/1985 | Giangerelli | 42/83 |
| 4,700,499 | 10/1987 | Knight | 42/51 |
| 5,016,379 | 5/1991 | Lambert | 42/83 |
| 5,133,143 | 7/1992 | Knight | 42/51 |

*Primary Examiner*—Charles T. Jordan
*Assistant Examiner*—Theresa M. Wesson
*Attorney, Agent, or Firm*—Zarley, McKee, Thomte, Voorhees, & Sease

[57] ABSTRACT

A nipple for a muzzle-loading firearm includes a generally cylindrical main body with a forward end of smaller diameter projecting forwardly and a rearward end of smaller diameter projecting rearwardly from the main body. An ignition bore extends completely through the nipple along the longitudinal axis thereof. The rearward end includes a tapered exterior surface with a forward tapered portion and a rearward tapered portion having different slopes. An annular groove is formed in the forward tapered portion slightly forward of the rearward tapered portion, and the rearward tapered portion preferably has a steeper slope than the forward tapered portion. Each tapered surface of the rearward end tapers to a smaller diameter from the main body rearwardly. A percussion cap is mounted on the rearward end of the nipple with the forward end of a cylindrical side wall in continuous contact along the rearward end of the forward tapered portion, aligned with the groove, to form an annular space between the rearward tapered portion and the cylindrical side wall of the percussion cap.

11 Claims, 2 Drawing Sheets

5-5

NIPPLE FOR MUZZLE-LOADING FIREARM

TECHNICAL FIELD

The present invention relates generally to muzzle-loading firearms, and more particularly to an improved nipple for use with a percussion cap in a muzzle-loading rifle.

BACKGROUND OF THE INVENTION

The conventional muzzle-loading rifle includes a barrel which extends forwardly from a receiver, the rearward end of the barrel having a breech which receives propellant and a projectile. A breech plug is threadably mounted in the receiver and seals the rearward end of the barrel, and the breech, to prevent blow-back of gases upon ignition of the propellant within the breech.

In many muzzle-loaders, a nipple is mounted in the rear end of the breech plug with a projecting rearward end adapted to receive a percussion cap thereon. When struck by a hammer, the percussion cap is fired and ignition sparks travel through a central bore the length of the nipple to ignite the propellant in the breech.

One problem with existing nipples for muzzle loaders is in maintaining the percussion caps on the nipple while hunting, especially when firing in adverse weather conditions. Improper seating of the percussion cap on the nipple commonly causes misfires.

Another common problem with prior art muzzle loader nipples is the use of vent holes in the side of the nipple in order to expand/breakup the cap after firing. These vent holes weaken the nipple, causing the nipple to deform after multiple firings, thereby resulting in improper seating of the percussion cap or an inability to put the cap on the nipple.

SUMMARY OF THE INVENTION

It is therefore a general object of the present invention to provide an improved nipple for muzzle-loading firearms.

Another object is to provide a nipple which assists in seating a percussion cap without requiring the use of special tools or procedures.

A further object of the present invention is to provide a nipple which causes expansion/breakup of the percussion cap without the need for vent holes in the nipple.

These and other objects will be apparent to those skilled in the art.

The nipple for a muzzle-loading firearm of the present invention includes a generally cylindrical main body with a forward end of smaller diameter projecting forwardly and a rearward end of smaller diameter projecting rearwardly from the main body. An ignition bore extends completely through the nipple along the longitudinal axis thereof. The rearward end includes a tapered exterior surface with a forward tapered portion and a rearward tapered portion having different slopes. An annular groove is formed in the forward tapered slightly forward of the rearward tapered portion, and the rearward tapered portion preferably has a steeper slope than the forward tapered portion. Each tapered surface of the rearward end tapers to a smaller diameter from the main body rearwardly. A percussion cap is mounted on the rearward end of the nipple with the forward end of a cylindrical side wall in continuous contact along the rearward end of the forward tapered portion, aligned with the groove, to form an annular space between the rearward tapered portion and the cylindrical side wall of the percussion cap.

DESCRIPTION OF THE PREFERRED EMBODIMENT

Figures 1, 2, 3, 4, 5:
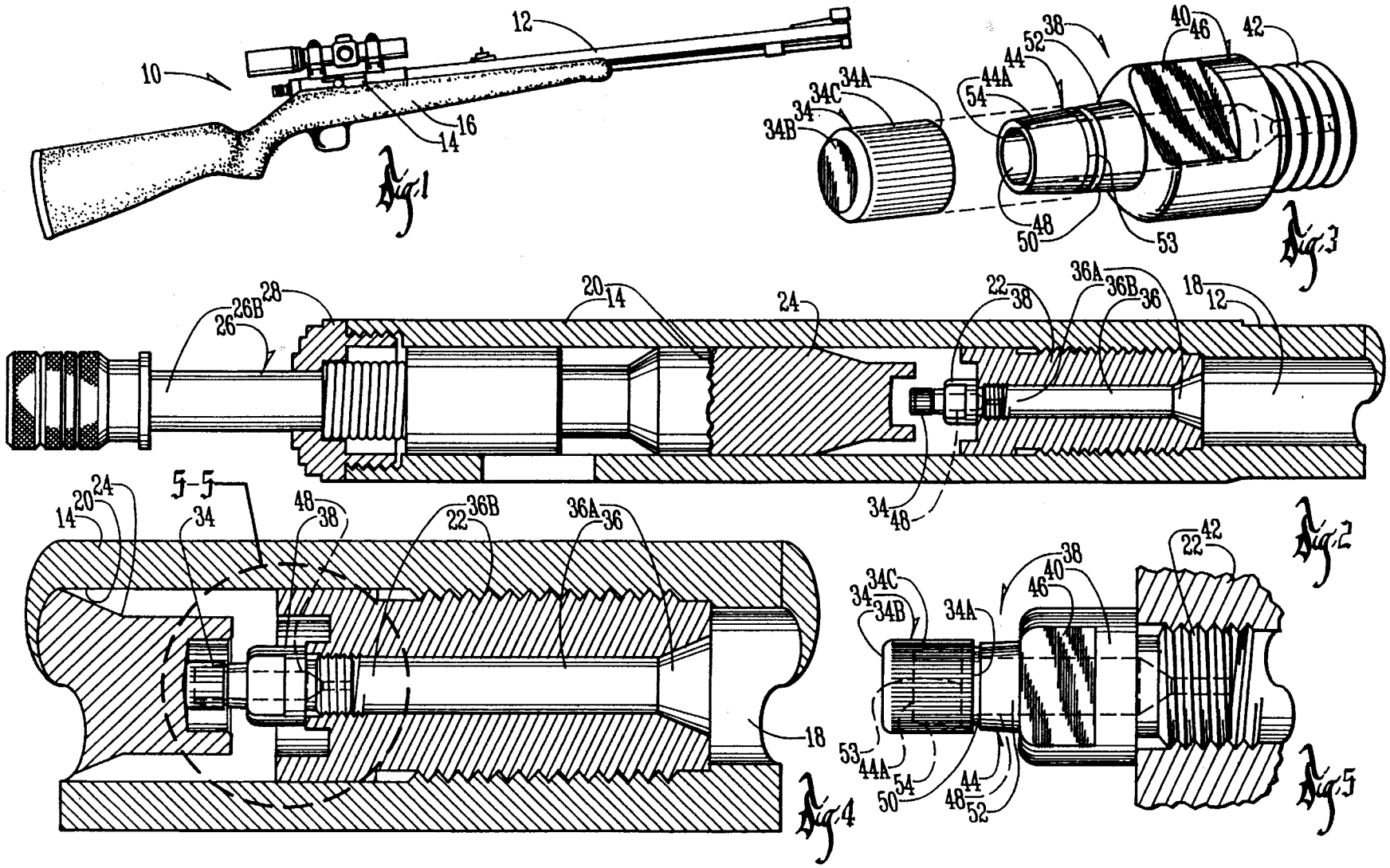
FIG. 1 is a side view of muzzle-loading firearm incorporating the nipple of the present invention.
FIG. 2 is an enlarged sectional view through the receiver portion of the muzzle loader showing the nipple of the present invention installed in a breech plug.
FIG. 3 is a super enlarged perspective view of the nipple of the present invention with a percussion cap aligned for seating thereon.
FIG. 4 is a super enlarged sectional view through the forward portion of the receiver, showing the breech plug and nipple installed thereon.
FIG. 5 is an enlarged view of a portion of FIG. 4, showing the rearward end of the breech plug with the nipple installed therein.

Referring now to the drawings, in which similar or corresponding parts are identified with the same reference numeral, and more particularly to FIG. 1, a muzzle-loading rifle is designated generally at 10 and includes a barrel 12 extending forwardly from a receiver 14 mounted on a stock 16.

Referring now to FIG. 2, the numeral 18 refers generally to the breech, located at the rearward end of barrel 12 and designed to receive the propellant and a projectile. Receiver 14 includes an internal cylindrical bore 20 having forward and rearward ends, with a breech plug 22 threaded into interior threads in the forward end of bore 20, and a hammer 26 slidably mounted within bore 20 rearwardly of breech plug 22, with the head 24 slidably mounted in the rearward end of receiver bore 20. An end cap 28 maintains the hammer within bore 20, and includes an aperture through which a rearwardly projecting shaft **26*b* of hammer 26 is journaled. The projecting end of hammer shaft 26*b* serves as a cocking handle for hammer 26**.

The head 24 of hammer 26 serves to strike a percussion cap 34 to ignite propellant within the breech. As shown in FIG. 4, breech plug 22 includes a central bore 36 with a forward end **36*a* communicating with breech 18 and an interiorly threaded rearward end 36*b***.

Referring now to FIGS. 3 and 5, the nipple of the present invention is designated generally at 38 and includes a generally cylindrical main body 40, a forward end 42 having a smaller exterior diameter than main body 40 and a rearward end 44 having a smaller exterior diameter than main body 40. Forward end 42 is exteriorly threaded to engage the interior threaded rearward end **36*b* of central bore 36 of breech plug 22. Diametric sides of the main body 40 are flattened to form opposing shoulders 46 on the rearward end of main body 40 to receive a tool for screwing nipple 38 into breech plug 22**.

A conventional ignition bore 48 is formed along the longitudinal axis of nipple 38 from rearward end 44 to forward end 42, to provide passage of ignition sparks to propellant within the breech. Rearward end 44 is designed with a tapered exterior surface tapering from a larger diameter adjacent main body 40 to a narrower diameter at the rearward rim 44*a*. The surface of rearward end 44 has two different tapered slopes, forming a forward tapered surface 52 and a rearward tapered surface 54 intersecting at an annular junction 53 generally midway between the forward end and rearward rim 44*a* of rearward end 44. Preferably, the slope of the forward tapered surface 52 is less than the slope of the rearward tapered surface 54. The preferred slope of forward tapered surface 52 is approximately 2° 13' from a line parallel to the longitudinal axis of ignition bore 48, while the slope of the rearward tapered surface 54 is approximately 5° 40' from a line parallel to the longitudinal axis of the ignition bore. An annular groove 50 extends around the circumference of forward tapered surface 52 preferably located 0.09 inches from forward end of rearward end 44, and provides a visual check to see that percussion cap 34 is properly seated on the rearward end of forward tapered surface 52 as shown in FIG. 5.

Figure 6:
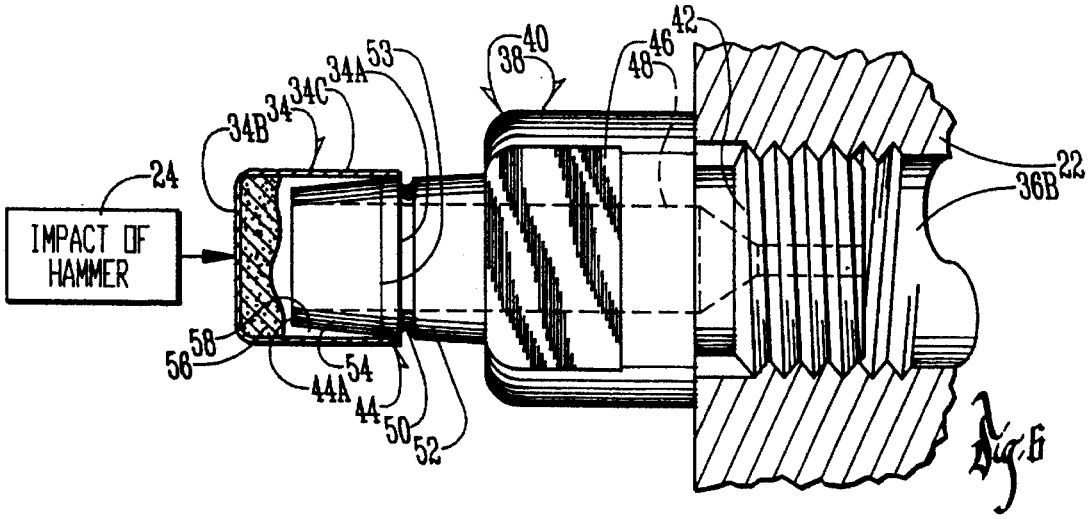
FIG. 6 is a view similar to FIG. 5 with a percussion cap shown in sectional view installed on the rearward end of the nipple.
Figure 7:
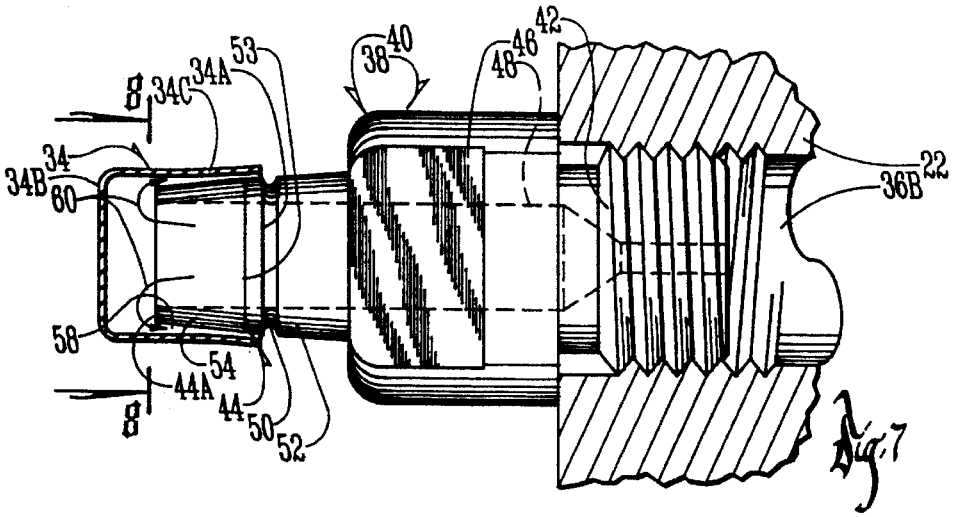
FIG. 7 is a side elevational view similar to FIG. 6 immediately after impact of the hammer on the percussion cap.
Figure 8:
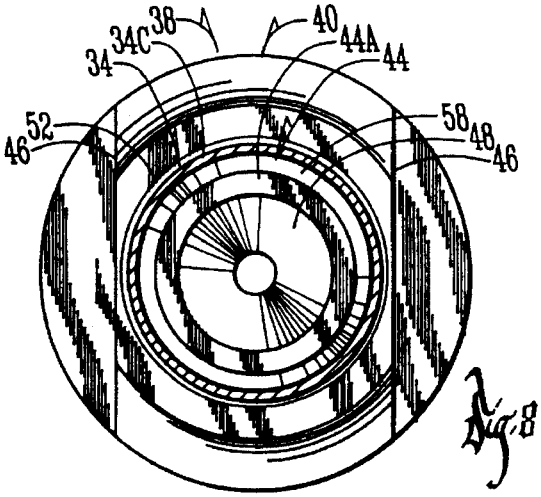
FIG. 8 is a sectional view taken at lines 8—8 in FIG. 7.

Referring now to FIGS. 6 and 7, percussion cap 34 has a cylindrical cup shape with a charge of igniter material 56 therein. When properly seated, cap 34 has its forward open end 34*a* aligned with the edge of groove 50, as shown in FIG. 6.

Upon impact of the hammer on the base 34*b* of percussion cap 34, charge 56 will ignite causing heated gases to rapidly expand and causing sparks to be pushed through ignition bore 48 so as to ignite propellant in the breech, as shown in FIG. 4. FIG. 7 shows that the rearward tapered surface 54 causes a space to be formed between percussion cap cylindrical side wall 34*c* and rearward tapered surface 54. This annular expansion space, designated generally at 58 in FIG. 7, allows gases to go around the rearward end of the nipple, as shown by arrows 60, into expansion space 58 to cause the expansion and breakup of cap 34. This expansion and breakup of the cap permits easy removal after firing.

The use of a taper of lesser slope of forward tapered surface 52, rearwardly of groove 50, maintains a water resistant seal between the nipple and the percussion cap 34, to thereby insure firing when the cap is struck by the firing pin in adverse weather conditions.

Whereas the invention has been shown and described in connection with the preferred embodiments thereof, it should be understood that many modifications, substitutions, and additions may be made which are within the intended broad scope of the appended claims.

I claim:

1. A nipple for a muzzle loader firearm, comprising:

a generally cylindrical main body;

a forward end projecting coaxially forwardly from the main body and having an exterior diameter less than the exterior diameter of the main body;

a rearward end projecting coaxially rearwardly from the main body and having an exterior diameter less than the exterior diameter of the main body; and an ignition bore extending from a rearward rim of the rearward end through the rearward end, main body and forward end, coaxial with said main body;

said rearward end having a sloped exterior surface tapering from a forward end adjacent the main body to a smaller diameter at the rearward rim;

said rearward end exterior surface having a forward tapered surface and a rearward tapered surface adjoining at a circumferential junction, the rearward surface being tapered at a slope greater than the slope of the forward surface.

2. The nipple of claim 1, wherein the forward tapered surface has a slope of approximately 2° 13' relative to a line parallel to the longitudinal axis of the rearward end.

3. An ignition system for a muzzle-loading firearm, comprising:

a generally cylindrical breech plug having a bore extending axially therethrough from a rearward end to a forward end;

a nipple removably mounted in the rearward end of the breech plug bore and having an ignition bore formed axially therethrough, coaxial with the breech plug bore; said nipple including:

a generally cylindrical main body;

a forward end projecting coaxially forwardly from the main body, having exterior diameter less than that of the main body and removably engaged in the rearward end of the breech plug bore; and a rearward end projecting coaxially rearwardly from the main body and having an exterior diameter less than that of the main body;

said rearward end having a sloped exterior surface tapering from adjacent the main body to a smaller diameter at a rearward rim; and a percussion cap seated on the rearward end of said nipple, including a cylindrical side wall, a circular base, and a charge of igniter material therein;

said percussion cap seated with a forward end of the side wall in continuous contact with the exterior surface of the nipple rearward end, intermediate the rearward rim and main body, and with an annular space formed between the cap side wall and rearward end exterior surface;

said nipple rearward end exterior surface having a forward tapered surface and a rearward tapered surface adjoined at a circumferential junction, and wherein said cap is seated with the side wall forward end in continuous contact with the forward tapered surface forwardly of said junction.

4. A muzzle-loading firearm, comprising:

a receiver having rearward and forward ends, mounted on a gun stock;

a barrel extending forwardly from the forward end of the receiver and having a breech at its rearward end;

said receiver including a threaded opening adjacent its forward end for threadably receiving a breech plug therein;

a breech plug threadably mounted in said threaded opening of the receiver, having forward and rearward ends and an elongated bore extending therebetween, said breech plug bore forward end communicating with the barrel breech;

a nipple removably mounted in the rearward end of the breech plug bore and having an ignition bore formed axially therethrough, coaxially with the breech plug bore;

said nipple including:

a generally cylindrical main body;

a forward end projecting coaxially forwardly from the main body, having exterior diameter less than that of the main body and removably engaged in the rearward end of the breech plug bore; and a rearward end projecting coaxially rearwardly from the main body and having an exterior diameter less than that of the main body;

said rearward end having a sloped exterior surface tapering from adjacent the main body to a smaller diameter at a rearward rim; and a percussion cap seated on the rearward end of said nipple, including a cylindrical side wall, a circular base, and a charge of igniter material therein;

said percussion cap seated with a forward end of the side wall in continuous contact with the exterior surface of the nipple rearward end, intermediate the rearward rim and main body, and with an annular space formed between the cap side wall and rearward end exterior surface;

said nipple rearward end exterior surface having a forward tapered surface and a rearward tapered surface adjoined at a circumferential junction, and wherein said cap is seated with the side wall forward end in continuous contact with the forward tapered surface forwardly of said junction.

5. A nipple for a muzzle loader firearm, comprising:

a generally cylindrical main body;

a forward end projecting coaxially forwardly from the main body and having an exterior diameter less than the exterior diameter of the main body;

a rearward end projecting coaxially rearwardly from the main body and having an exterior diameter less than the exterior diameter of the main body;

an ignition bore extending from a rearward rim of the rearward end through the rearward end, main body and forward end, coaxial with said main body;

said rearward end having a sloped exterior surface tapering from a forward end adjacent the main body to a smaller diameter at the rearward rim; and said rearward end exterior surface having an annular groove formed around the circumference thereof, spaced a predetermined distance from the rearward rim.

6. A nipple for a muzzle loader firearm, comprising:

a generally cylindrical main body;

a forward end projecting coaxially forwardly from the main body and having an exterior diameter less than the exterior diameter of the main body;

a rearward end projecting coaxially rearwardly from the main body and having an exterior diameter less than the exterior diameter of the main body;

an ignition bore extending from a rearward rim of the rearward end through the rearward end, main body and forward end, coaxial with said main body;

said rearward end having a sloped exterior surface tapering from a forward end adjacent the main body to a smaller diameter at the rearward rim;

said rearward end exterior surface having a forward tapered surface and a rearward tapered surface adjoining at a circumferential junction, the rearward surface being tapered at a slope greater than the slope of the forward surface; and said rearward surface having a slope of approximately 5° 40' relative to a line parallel to the longitudinal axis of the rearward end.

7. A nipple for a muzzle loader firearm, comprising:

a generally cylindrical main body;

a forward end projecting coaxially forwardly from the main body and having an exterior diameter less than the exterior diameter of the main body;

a rearward end projecting coaxially rearwardly from the main body and having an exterior diameter less than the exterior diameter of the main body;

an ignition bore extending from a rearward rim of the rearward end through the rearward end, main body and forward end, coaxial with said main body;

said rearward end having a sloped exterior surface tapering from a forward end adjacent the main body to a smaller diameter at the rearward rim;

said rearward end exterior surface having a forward tapered surface and a rearward tapered surface adjoining at a circumferential junction, the rearward surface being tapered at a slope greater than the slope of the forward surface; and said forward tapered surface having an annular groove formed around the circumference thereof, spaced forwardly of said junction.

8. A nipple for a muzzle loader firearm, comprising:

a generally cylindrical main body;

a forward end projecting coaxially forwardly from the main body and having an exterior diameter less than the exterior diameter of the main body;

a rearward end projecting coaxially rearwardly from the main body and having an exterior diameter less than the exterior diameter of the main body;

an ignition bore extending from a rearward rim of the rearward end through the rearward end, main body and forward end, coaxial with said main body;

said rearward end having a sloped exterior surface tapering from a forward end adjacent the main body to a smaller diameter at the rearward rim;

a percussion cap seated on the rearward end sealing the ignition bore therethrough;

said percussion cap including a cylindrical side wall, a circular base, and a charge of ignition material therein;

said percussion cap seated with a forward end of the side wall in continuous contact with the exterior surface of the nipple rearward end, intermediate the rearward rim and main body, and with an annular space formed between the cap side wall and rearward end, said space extending from the rearward rim substantially to the forward end of the percussion cap; and an annular groove formed in the nipple rearward end exterior surface, located a distance from the rearward rim such that said percussion cap is properly seated on the nipple when the cap forward end is aligned along the groove.

9. An ignition system for a muzzle-loading firearm, comprising:

a generally cylindrical breech plug having a bore extending axially therethrough from a rearward end to a forward end;

a nipple removably mounted in the rearward end of the breech plug bore and having an ignition bore formed axially therethrough, coaxial with the breech plug bore;

said nipple including:

a generally cylindrical main body;

a forward end projecting coaxially forwardly from the main body, having exterior diameter less than that of the main body and removably engaged in the rearward end of the breech plug bore; and a rearward end projecting coaxially rearwardly from the main body and having an exterior diameter less than that of the main body;

said rearward end having a sloped exterior surface tapering from adjacent the main body to a smaller diameter at a rearward rim; and a percussion cap seated on the rearward end of said nipple, including a cylindrical side wall, a circular base, and a charge of igniter material therein;

said percussion cap seated with a forward end of the side wall in continuous contact with the exterior surface of the nipple rearward end, intermediate the rearward rim and main body, and with an annular space formed between the cap side wall and rearward end exterior surface; and an annular groove formed in the nipple rearward end exterior surface, located a distance from the rearward rim such that said percussion cap is properly seated on the nipple when the cap forward end is aligned along the groove.

10. A muzzle-loading firearm, comprising:

a receiver having rearward and forward ends, mounted on a gun stock;

a barrel extending forwardly from the forward end of the receiver and having a breech at its rearward end;

said receiver including a threaded opening adjacent its forward end for threadably receiving a breech plug therein;

a breech plug threadably mounted in said threaded opening of the receiver, having forward and rearward ends and an elongated bore extending therebetween, said breech plug bore forward end communicating with the barrel breech;

a nipple removably mounted in the rearward end of the breech plug bore and having an ignition bore formed axially therethrough, coaxially with the breech plug bore;

said nipple including:

a generally cylindrical main body;

a forward end projecting coaxially forwardly from the main body, having exterior diameter less than that of the main body and removably engaged in the rearward end of the breech plug bore; and a rearward end projecting coaxially rearwardly from the main body and having an exterior diameter less than that of the main body;

said rearward end having a sloped exterior surface tapering from adjacent the main body to a smaller diameter at a rearward rim; and a percussion cap seated on the rearward end of said nipple, including a cylindrical side wall, a circular base, and a charge of igniter material therein;

said percussion cap seated with a forward end of the side wall in continuous contact with the exterior surface of the nipple rearward end, intermediate the rearward rim and main body, and with an annular space formed between the cap side wall and rearward end exterior surface; and an annular groove formed in the rearward end exterior surface, located a distance from the rearward rim such that said percussion cap is properly seated on the nipple when the cap forward end is aligned along the groove.

11. A nipple for a muzzle loader firearm, comprising:

a generally cylindrical main body;

a forward end projecting coaxially forwardly from the main body and having an exterior diameter less than the exterior diameter of the main body;

a rearward end projecting coaxially rearwardly from the main body and having an exterior diameter less than the exterior diameter of the main body;

an ignition bore extending from a rearward rim of the rearward end through the rearward end, main body and forward end, coaxial with said main body;

said rearward end having a sloped exterior surface tapering from a forward end adjacent the main body to a smaller diameter at the rearward rim;

a percussion cap seated on the rearward end sealing the ignition bore therethrough;

said percussion cap including a cylindrical side wall, a circular base, and a charge of ignition material therein;

said percussion cap seated with a forward end of the side wall in continuous contact with the exterior surface of the nipple rearward end, intermediate the rearward rim and main body, and with an annular space formed between the cap side wall and rearward end, said space extending from the rearward rim substantially to the forward end of the percussion cap; and said nipple rearward end exterior surface having a forward tapered surface and a rearward tapered surface adjoined at a circumferential junction, and wherein said cap is seated with the side wall forward end in continuous contact with the forward tapered surface forwardly of said junction.

* * * * *